United States Patent [19]

Horton

[11] Patent Number: 4,691,735

[45] Date of Patent: Sep. 8, 1987

[54] PLUNGER VALVE APPARATUS FOR OIL WELL PUMP

[76] Inventor: James B. Horton, P.O. Box 1758, Kilgore, Tex. 75662

[21] Appl. No.: 914,563

[22] Filed: Oct. 2, 1986

Related U.S. Application Data

[63] Continuation of Ser. No. 732,625, May 10, 1985, abandoned.

[51] Int. Cl.[4] ..... F16K 15/04

[52] U.S. Cl. ..... 137/494; 137/533.13; 137/533.15; 417/507; 417/554

[58] Field of Search ..... 137/533.11, 533.13, 137/533.15, 494; 417/507, 554

[56] References Cited

U.S. PATENT DOCUMENTS

| | | | |
|---|---|---|---|
| 799,132 | 9/1905 | Allen | 417/554 |
| 880,019 | 2/1908 | Futhey . | |
| 1,383,005 | 6/1921 | Mertens . | |
| 1,464,301 | 8/1923 | Thompson . | |
| 1,481,651 | 1/1924 | Nickson . | |
| 1,513,985 | 11/1924 | Gunn | 137/533.13 |
| 1,585,544 | 5/1926 | Hubbard | 417/507 |
| 1,632,216 | 6/1927 | Bradley . | |
| 1,852,920 | 4/1932 | Combs . | |
| 2,014,827 | 9/1935 | Williams . | |
| 2,174,121 | 9/1939 | Collins . | |
| 2,211,074 | 8/1940 | Raulerson . | |
| 2,215,558 | 9/1940 | Miller . | |
| 2,278,715 | 4/1942 | Stoyke | 137/533.13 |
| 2,578,069 | 12/1951 | Jones | 137/533.15 X |
| 2,628,571 | 2/1953 | Neilsen | 137/533.15 X |
| 2,693,767 | 11/1954 | Vroman . | |
| 3,090,324 | 5/1963 | Schmidt . | |
| 3,139,039 | 6/1964 | Adams . | |
| 3,428,086 | 2/1969 | Glasgow . | |
| 3,521,853 | 6/1970 | Gillis et al. . | |
| 3,543,682 | 12/1970 | Farrow . | |
| 3,645,286 | 2/1972 | Follett . | |
| 3,861,471 | 1/1975 | Douglas . | |
| 3,947,158 | 3/1976 | Gage . | |
| 4,018,248 | 4/1977 | Carr . | |
| 4,229,149 | 10/1980 | Turner . | |
| 4,244,398 | 1/1981 | Tengan . | |
| 4,407,360 | 10/1983 | Hamrock . | |

*Primary Examiner*—Robert G. Nilson

*Attorney, Agent, or Firm*—Michael A. O'Neil

[57] ABSTRACT

A traveling valve or a standing valve for an oil well lift pump 10 includes a piston 36 which lifts a ball 50 above the valve seat 48 to open the valve and sets the ball 50 back onto the seat 48 to close the valve. The ball 50 is contained within a ball protection shield 52 which prevents uncontrolled movement by the ball 50 inside the middle tube 18. The piston 36 has openings 42, and the ball protection shield 52 has apertures 60 which allow fluid to flow through the the valve without engaging the ball 50.

10 Claims, 2 Drawing Figures

PLUNGER VALVE APPARATUS FOR OIL WELL PUMP

CROSS-REFERENCE TO RELATED APPLICATIONS

This application is a continuation of application Ser. No. 732,625, filed May 10, 1985, now abandoned.

TECHNICAL FIELD

This invention relates generally to check valves for controlling fluid flow in reciprocating pumps of the type used in a subsurface oil well pump apparatus, and more particularly to standing and traveling valve assemblies including a ball actuating piston and a ball protection shield.

BACKGROUND AND SUMMARY OF THE INVENTION

The basic lift pump was developed to bring subsurface liquids to the surface. A typical lift pump contains a standing valve and a traveling valve each comprised of a ball and a seat. When the lift pump makes a down stroke, the tubing which contains the traveling valve is lowered relative to the casing in which the standing valve is mounted. The resulting fluid pressure raises the ball of the traveling valve, allowing fluid to enter the tubing. During the subsequent up stroke, the tubing is raised, the ball falls into the traveling valve seat and fluid is trapped inside the tubing. The pressure inside the casing drops, causing fluid to enter the casing by raising the standing valve ball off of the standing valve seat. The succeeding down stroke of the lift pump again lowers the tubing, increasing the pressure in the casing. The standing valve ball drops into the standing valve seat, thereby sealing the interior of the casing, and the traveling valve opens permitting more fluid to enter the tubing.

This process exposes both the standing valve and the traveling valve to considerable deterioration. For instance, sand or corrosive materials contained in the fluid can gradually destroy the ball of each valve. Another problem involves uncontrolled movement of the traveling valve ball inside the tubing and the standing valve ball inside the casing. Deterioration of either ball results in an imperfect seal between that ball and its respective valve seat, thus allowing fluid to leak out of the casing or the tubing. As a result, costly repairs are frequently needed during which the pump is out of operation. Protecting the standing valve ball and the traveling valve ball from the corrosive materials and the sand and grit present in the well fluid and preventing uncontrolled movement of both balls inside the casing and the tubing considerably increases the working life of both the standing valve and the traveling valve and high efficiency is maintained without the frequent, costly repairs and the resulting down time.

According to the present invention, the increase in fluid pressure below the traveling valve which occurs when the tubing is lowered into the casing causes a piston situated just below the traveling valve seat to rise. The piston lifts the traveling valve ball out of the traveling valve seat. A protector shield contains and protects the traveling valve ball from the fluid flow and uncontrolled movement inside the tubing while the traveling valve is open. Likewise, when the tubing is raised the drop in pressure inside the casing causes a similar piston to lift the standing valve ball out of the standing valve seat. A second protection shield contains and protects the standing valve ball from fluid flow and uncontrolled movement inside the casing while the standing valve is open.

BRIEF DESCRIPTION OF DRAWINGS

A more complete understanding of the invention can be had by reference to the following Detailed Description in conjunction with the accompanying Drawings, wherein.

DETAILED DESCRIPTION

Figure 1:
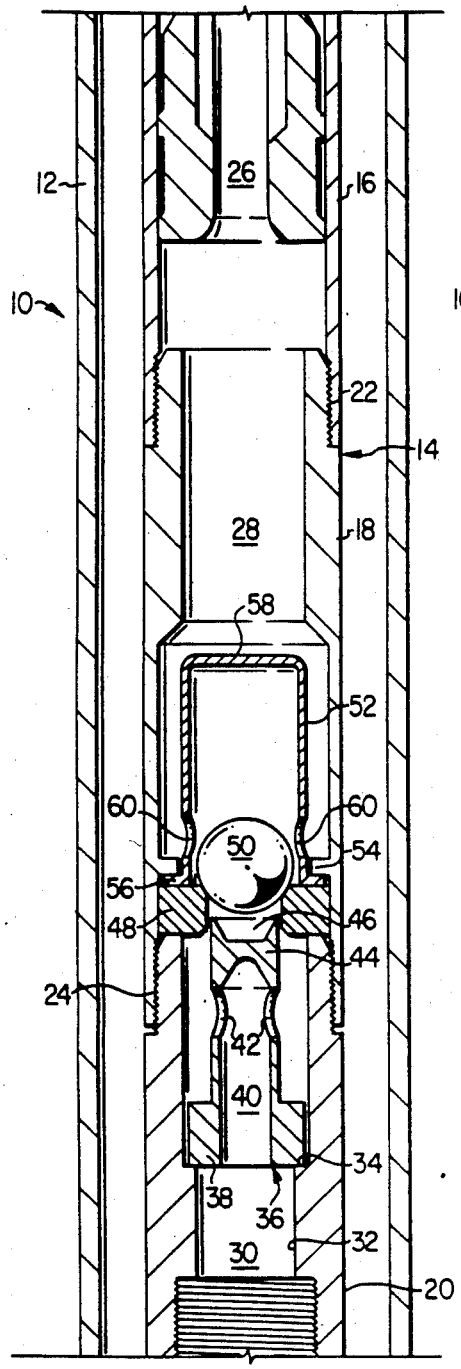
FIG. 1 depicts the traveling valve of the present invention in a closed position.
Figure 2:
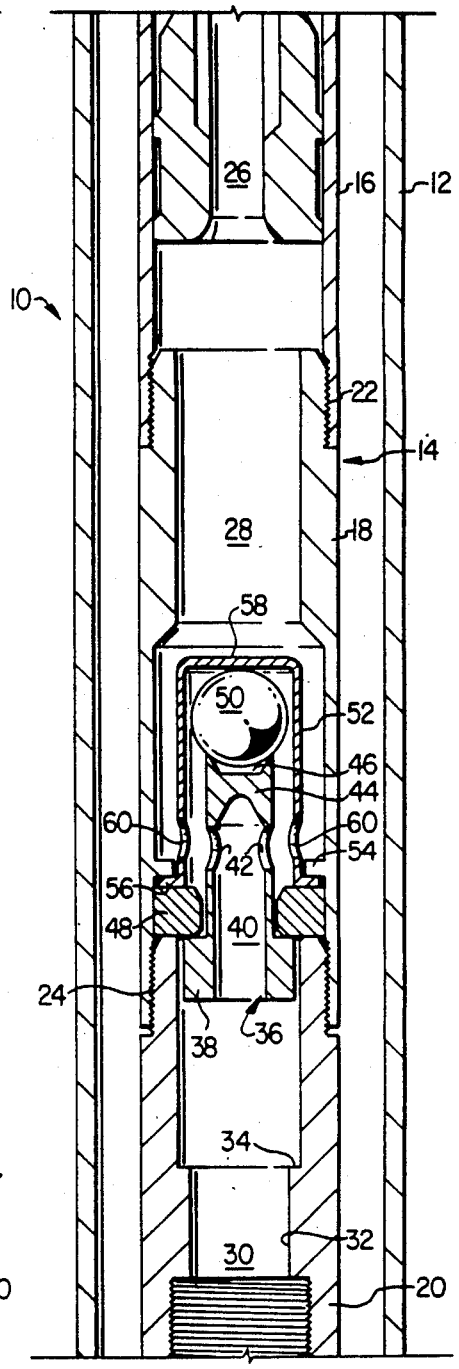
FIG. 2 depicts the traveling valve in an open position.

Referring to FIGS. 1 and 2, a section of a pump 10 is shown. The pump 10 comprises a casing 12 and a tubing 14 inside the casing 12. The tubing 14 comprises an upper tube 16, a middle tube 18 and a lower tube 20. The upper tube 16 is threadably connected to the middle tube 18 at 22. The middle tube 18 is threadably connected to the lower tube 20 at 24. The upper tube 16 has a hollow interior 26, the middle tube 18 has a hollow interior 28, and the lower tube 20 has a hollow interior 30. The upper tube 16, middle tube 18 and lower tube 20 can be made of any conventional material such as steel.

The inner wall 32 of the lower tube 20 is formed with a notch 34. As shown in FIG. 1, a piston 36 in the interior 30 of the lower tube 20 has a buttress 38 which can engage the inner wall 32 of the tube 20 at the notch 34. The piston 36 has a hollow interior 40 and openings 42 near its upper end. The piston 36 is sealed at its top 44 and a ball receptacle 46 is formed on the top 44 of the piston 36. The piston 36 is of such a length that when resting on the notch 34, the ball receptacle 46 extends slightly higher than the upper edge of the lower tube 20. The piston 36 may be formed of any conventional material such as steel.

Fixedly mounted on top of the lower tube 20 and inside the middle tube 18 is a valve seat 48. A ball 50 above the valve seat 48 is of such a size that it engages the valve seat 48 as shown in FIG. 1. Fixedly mounted on the top of the valve seat 48 is a ball protection shield 52. The valve seat 48, ball 50, and ball protection shield 52 can also be made of any conventional material such as steel.

An inwardly extending notch 54 is formed in the inner wall of the middle tube 18. When the lower tube 20 is threaded into the middle tube 18, the valve seat 48 and the lower lip 56 of the ball protection shield 52 are sandwiched between and thus fixedly mounted between the lower tube 20 and the inwardly extending notch 54.

The ball protection shield 52 has a sealed top end 58 and apertures 60 near its base. The apertures 60 are positioned to be adjacent the openings 42 in the piston 36 when the piston 36 is in a raised position as shown in FIG. 2.

In the operation of the pump 10, the tubing 14 is lowered relative to the casing 12. Lowering the tubing 14 into the casing 12 causes the fluid pressure in the interior 30 of the lower tube 20 to rise. This rise in fluid pressure elevates the piston 36 from the position shown in FIG. 1 to the position shown in FIG. 2.

When the piston 36 rises, the ball receptacle 46 engages the ball 50 and raises it above the valve seat 48 and into the ball protection shield 52. Because of the increased pressure, the fluid in the interior 30 of the lower tube 20 flows from the interior 30 through the hollow interior 40 of the piston 36 and out the openings 42 in the piston 36. The fluid flows through the apertures 60 in the ball protection shield 52 and up into the interior 28 of the middle tube 18.

In the succeeding stroke of the pump 10, the tubing 14 is raised relative to the casing 12. As a result, the fluid pressure in the interior 30 of the lower tube 20 drops, and the combination of the lower fluid pressure and gravity causes the piston 36 to fall until the buttress 38 engages the notch 34 as shown in FIG. 1. The ball receptacle 46 thus returns the ball 50 to the valve seat 48. Engaging the ball 50 with the valve seat 48 prevents fluid from flowing down from the interior 28 of the middle tube 18 through the apertures 60 of the ball protection shield 52 and into the interior 30 of the lower tube 20. During the next succeeding stroke of the pump 10, the tubing 14 is again lowered into the casing 12. The piston 30 again raises the ball 50 above the valve seat 48 and the fluid pressure in the interior 30 of the tube 20 causes more fluid to flow through the hollow interior 40, the openings 42, and the apertures 60 and into the interior 28 of the middle tube 18, thereby repeating the cycle. Thus, the ball 50 and the valve seat 48 form a traveling valve.

As can be seen from the above description, each succeeding stroke of the pump 10 raises the fluid level in the interior 28 of the middle tube 18. In this manner, the fluid is lifted into the interior 26 of the upper tube 16 and thereafter up to the surface.

Because the fluid must flow through the piston to reach the interior 28 of the middle tube 18 and because the piston 36 raises the ball 50 up into the ball protection shield 52, the ball 50 never comes in direct contact with flowing fluid. Thus, the corrosive materials and sand and grit contained in the flowing fluid do not come in direct contact with the ball 50. Furthermore, because the ball 50 is contained inside the ball protection shield 52, uncontrolled movement inside the middle tube 18 is prevented. Therefore, the ball 50 does not suffer from the deleterious effects of contact with the flowing fluid or of uncontrolled movement inside the middle tube 18. This substantially prolongs the effective life of the ball 50 and greatly increases the efficiency of the lift pump.

Although preferred embodiments of the invention has been illustrated in the accompanying Drawings and described in the foregoing Detailed Description, it will be understood that the invention is not limited to the embodiments disclosed, but is capable of numerous rearrangements, modifications, and substitutions of parts and elements without departing from the spirit of the invention. The invention is further not limited to the traveling valve disclosed in the foregoing DETAILED DESCRIPTION but may also be used as a standing valve.

I claim:

1. A valve comprising:

a casing extending into a body of liquid;

valve seat means fixedly mounted within said casing;

a ball positioned within said casing above said valve seat means;

a piston movably mounted within said casing below said valve seat means and adapted for reciprocation within said casing in response to fluid pressure and wherein said valve is closed by said ball engaging said valve seat means, and opened by a drop in fluid pressure above said piston causing said piston to rise, thereby lifting said ball away from said valve seat means; and a ball protection shield having a lower open end and an upper closed end fixedly mounted above said valve seat means and defining an enclosure in which said steel ball is contained, said shield having at least one aperture to permit fluid to flow through said shield, said aperture positioned entirely below the level to which said piston lifts the ball when said piston is in an elevated position.

2. The valve of claim 1 wherein said piston is a hollow shaft having an open bottom end, a sealed top end and at least one opening along its shaft wall.

3. The valve of claim 2 further comprising a ball receptacle on the sealed top end of said piston.

4. A valve within a tubular member which extends into and is adapted for vertical reciprocation relative to a body of liquid comprising:

valve seat means fixedly mounted within said tubular member;

a ball positioned inside said tubular member above said valve seat means capable of engaging with said valve seat means to close said valve and disengaging from said valve seat means to open said valve;

a piston slidably mounted within said tubular member below said valve seat means and adapted to respond to an increase in fluid pressure below said piston by rising, thereby lifting said ball and disengaging said ball from said valve seat means and to respond to a subsequent decrease in fluid pressure below said piston by falling, thereby engaging said ball with said valve seat means; and a ball protection shield fixedly mounted above said valve seat means and defining an enclosure in which said ball is contained that restricts the movement of said ball and protects said ball from deterioration, said shield having an upper closed end and a lower open end and an upper and a lower portion, the upper portion defining a cavity large enough to contain the ball and protect it from the fluid flow when the piston lifts the ball up out of the valve seat means and the lowre portion having at least one aperture formed at a level entirely below the level to which said piston lifts the ball when said piston is in an elevated position to permit fluid to flow through said shield.

5. The valve of claim 4 wherein said piston is a hollow shaft having an open bottom end, a sealed top end, and at least one opening along its shaft wall to permit fluid flow through said piston.

6. The valve of claim 5 further comprising a ball receptacle on the sealed top end of said piston for engaging and holding said ball when said piston is in an elevated position.

7. A valve within a casing which extends into a body of liquid comprising:

valve seat means fixedly mounted within said casing member;

a ball positioned inside said casing above said valve seat means capable of engaging with said valve seat means to close said valve and disengaging from said valve seat means to open said valve;

a piston slidably mounted within said casing below said valve seat means and adapted to respond to a decrease in fluid pressure above said piston by rising, thereby lifting said ball and disengaging said ball from said valve seat means and to respond to a subsequent increase in fluid pressure above said piston by falling, thereby engaging said ball with said valve seat means;

a ball protection shield fixedly mounted above said valve seat means and defining an enclosure in which said ball is contained that restricts the movement of said ball and protects said ball from deterioration, said shield having an upper, closed end and a lower open end and an upper and a lower portion, the upper portion defining a cavity large enough to contain the ball and protect it from the fluid flow when the piston lifts the ball up out of the valve seat means and the lower portion having at least one aperture formed at a level entirely below the level to which said piston lifts the ball when said piston is in an elevated position to permit fluid to flow through said shield.

8. The valve of claim 7 wherein said piston is a hollow shaft having an open bottom end, a sealed top end, and at least one opening along its shaft wall to permit fluid flow through said piston.

9. The valve of claim 8 further comprising a ball receptacle on the sealed top end of said piston for engaging and holding said ball when said piston is in an elevated piston.

10. A valve comprising:

at least one hollow cylindrical tube which extends into and is adapted for vertical reciprocation relative to a body of liquid;

cylindrical valve seat means fixedly mounted within said tube;

a steel ball above said valve seat means for engaging said seat means to close said valve and disengaging said seat means to open said valve;

a hollow cylindrical piston slidably mounted below said seat means having an upper sealed end and a lower open end, a ball receptacle means on the upper sealed end of said piston for engaging and lifting said steel ball above said seat means when fluid pressure below said piston acts on and raises said piston, thereby opening said valve, and for replacing said steel ball onto said seat means when fluid pressure below said piston drops and said piston falls, and at least one opening in the upper wall of said piston to allow fluid to react to the increase in pressure and flow from below said piston, through the center of said piston and out said opening when said valve is open; and a ball protection shield fixedly mounted above said seat means in which said steel ball is contained to restrict movement of said steel ball, said shield defining an enclosure having a lower open end and an upper closed end and an upper and a lower portion, the upper portion defining a cavity large enough to contain the ball and protect it from the fluid flow when the piston lifts the ball up out of the valve seat means and the lower portion having at least one aperture, said aperture positioned to be adjacent said opening in the upper wall of said piston when said piston is in an elevated position and entirely below the level to which the piston lifts the ball to open the valve to permit fluid to flow from inside said piston through said piston and said shield, said ball thereby being protected from direct contact with the flow of fluid.

* * * * *